US010302309B2

(12) United States Patent
Paller

(10) Patent No.: US 10,302,309 B2
(45) Date of Patent: May 28, 2019

(54) OVEN APPLIANCE HAVING A BROILER ASSEMBLY

(71) Applicant: Haier US Appliance Solutions, Inc., Wilmington, DE (US)

(72) Inventor: Hans Juergen Paller, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 237 days.

(21) Appl. No.: 15/412,104

(22) Filed: Jan. 23, 2017

(65) Prior Publication Data

US 2018/0209656 A1 Jul. 26, 2018

(51) Int. Cl.
*F24C 3/00* (2006.01)
*F24C 15/32* (2006.01)

(52) U.S. Cl.
CPC ..... *F24C 15/322* (2013.01)

(58) Field of Classification Search
CPC ..... F24C 3/004
USPC ..... 126/41 D, 21 R
See application file for complete search history.

(56) References Cited

U.S. PATENT DOCUMENTS 3,417,742 A * 12/1968 Perl ..... F24C 14/025 126/21 A
3,507,265 A * 4/1970 Dills ..... F24C 14/025 126/21 R
6,718,965 B2 4/2004 Rummel et al.
8,294,070 B2 * 10/2012 McNamee ..... A21B 1/245 219/679

FOREIGN PATENT DOCUMENTS

JP 1159536 A 6/1989

* cited by examiner

*Primary Examiner* — Avinash A Savani
(74) *Attorney, Agent, or Firm* — Dority & Manning, P.A.

(57) ABSTRACT

An oven appliance is generally provided. The oven appliance may include a cabinet and a convection broiler assembly. The cabinet may define a cooking chamber to receive items to be cooked and include a top wall, a bottom wall, a rear wall, and opposing sidewalls. The top wall and the bottom wall may be spaced apart along a vertical direction. The opposing sidewalls may be spaced apart along a lateral direction. The convection broiler assembly may include a broiler passage broiler passage defined along a top portion of the cooking chamber to direct a heated gas thereto, a heating element disposed in convective communication with the broiler passage to supply the heated gas therein, and an air handler in fluid communication with the heating element and the broiler plate to motivate the heated gas through the broiler passage.

15 Claims, 5 Drawing Sheets

OVEN APPLIANCE HAVING A BROILER ASSEMBLY

FIELD OF THE INVENTION

The present subject matter relates generally to oven appliances, and more particularly to oven appliances having a convection broiler assembly.

BACKGROUND OF THE INVENTION

Conventional residential and commercial oven appliances generally include a cabinet that defines a cooking chamber for receipt of food items for cooking. Heating elements are positioned within the cooking chamber to provide heat to food items located therein. The heating elements can include, for example, radiant heating elements, such as a bake heating assembly positioned at a bottom of the cooking chamber and/or a broiler heating assembly positioned at a top of the cooking chamber.

Some conventional appliances include a broiler assembly that use a burner or electric heating element directed toward a predefined heating surface. During use, the burner or electric heating element heats the predefined heating surface to an elevated temperature so that heat may be radiated above, for instance, a food item being cooked. In other words, radiation is used as the heat transfer method in these conventional broiler elements. Oftentimes, these conventional appliances are unable to provide an even or desirable heat distribution above the food item being cooked. For example, the broiler element may be unable to evenly heat the predefined heating surface. In turn, radiation from the predefined heating surface may heat or cook items in an undesirable or uneven manner.

Moreover, in conventional appliances, the broiler element may require a significant amount of pre-heating time before a suitable broiler temperature is reached. This additional pre-heating time may frustrate a user and/or hinder cooking operations.

Furthermore, some conventional broiler assemblies are disposed in a top portion of the cabinet. One or more elements may extend downward into the defined cooking chamber. The configuration may thereby reduce the usable volume of the cooking chamber, limiting the size of items that may be positioned therein.

Accordingly, oven appliances having an improved broiler assembly would be desirable. Specifically, oven appliances having a broiler assembly that could provide an even heat distribution across a portion of a cooking chamber would be desirable. Additionally, it may be desirable for broiler assemblies to quickly reach an instructed temperature. It may be further desirable for broiler assemblies to reduce the amount of cooking chamber volume otherwise dedicated to broiling elements.

BRIEF DESCRIPTION OF THE INVENTION

Aspects and advantages of the invention will be set forth in part in the following description, or may be obvious from the description, or may be learned through practice of the invention.

In one aspect of the present disclosure, an oven appliance is provided. The oven appliance may include a cabinet and a convection broiler assembly. The cabinet may define a cooking chamber to receive items to be cooked and include a top wall, a bottom wall, a rear wall, and opposing sidewalls. The top wall and the bottom wall may be spaced apart along a vertical direction. The opposing sidewalls may be spaced apart along a lateral direction. The convection broiler assembly may include a broiler passage broiler passage defined along a top portion of the cooking chamber to direct a heated gas thereto, a heating element disposed in convective communication with the broiler passage to supply the heated gas therein, and an air handler in fluid communication with the heating element and the broiler plate to motivate the heated gas through the broiler passage.

In another aspect of the present disclosure, an oven appliance is provided. The oven appliance may include a cabinet, a convection duct, a heating element, an air handler, and a broiler passage. The convection duct may extend along a portion of the cooking chamber to direct a heated gas therethrough. The heating element may be disposed within the convection duct to supply the heated gas thereto. The air handler may be disposed in fluid communication with the convection duct to motivate the heated gas. The broiler passage may be defined at a top portion of the cooking chamber in fluid communication with the convection duct to direct the heated gas from the convection duct to the cooking chamber.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
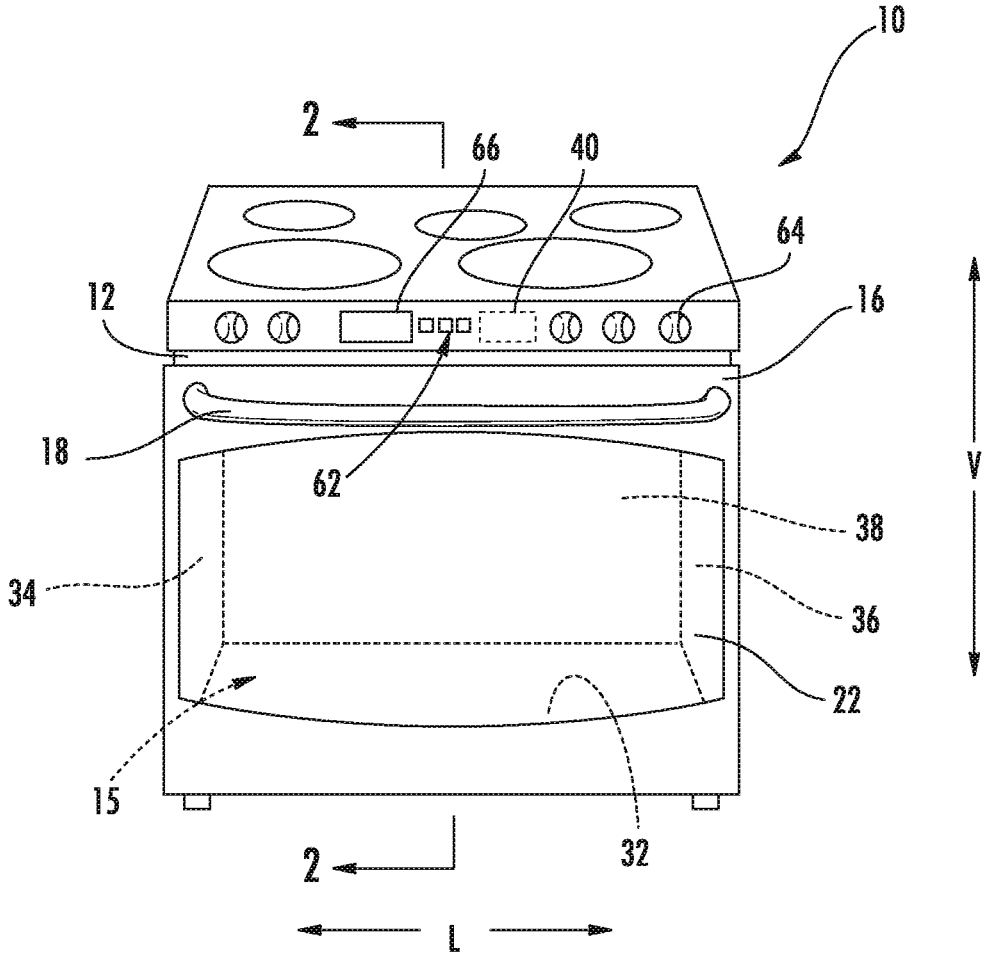
FIG. 1 provides a front perspective view of an oven appliance according to example embodiments of the present disclosure.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

Generally, some aspects of the present disclosure provide an oven appliance that includes a convection broiler assembly for broiling food items placed within a cooking chamber of the oven appliance. The convection broiler can include a heating element that is kept outside of the cooking chamber. However, heat generated by the heating element can be blown to the cooking chamber by an air handler. A broiler plate may be placed in the cooking chamber to receive hot air from the heating element and guide it into the cooking chamber.

Figure 2:
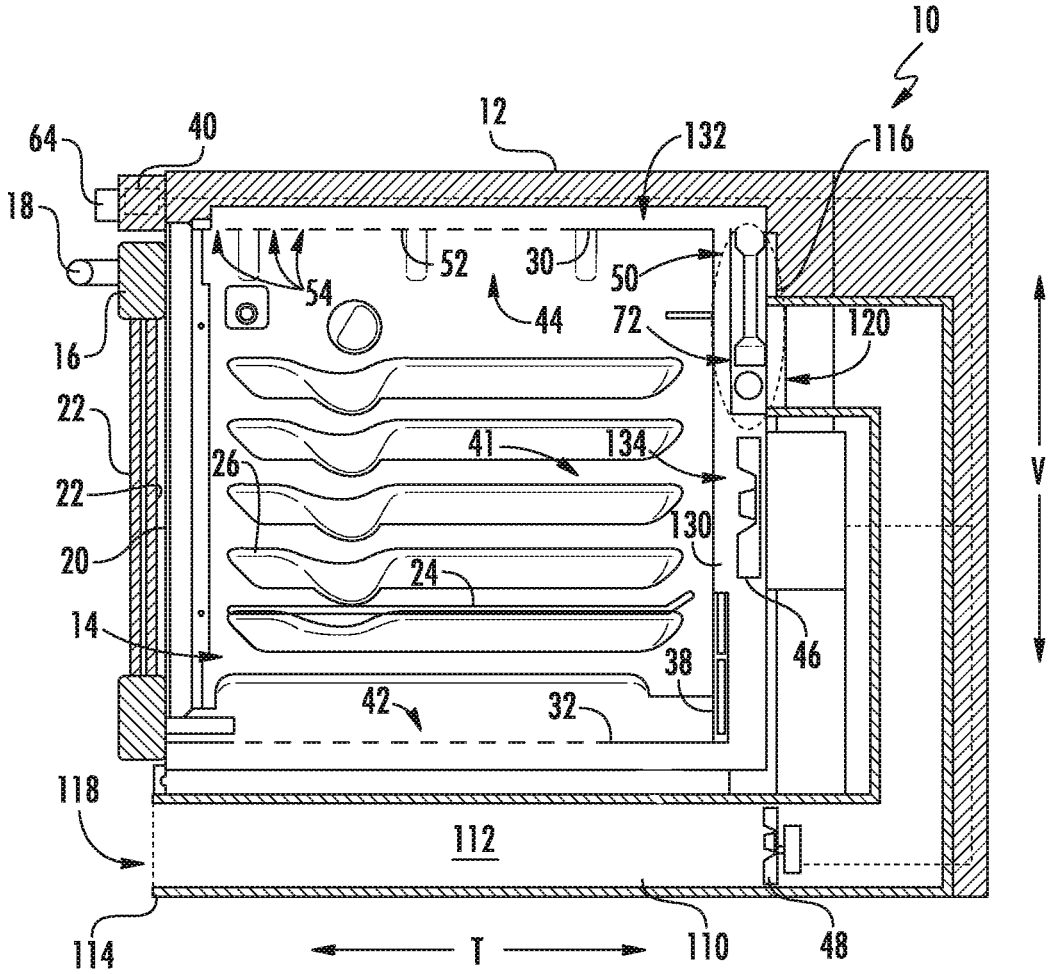
FIG. 2 provides a sectional view of the example oven appliance of FIG. 1 taken along the line 2-2 of FIG. 1.
Figure 3:
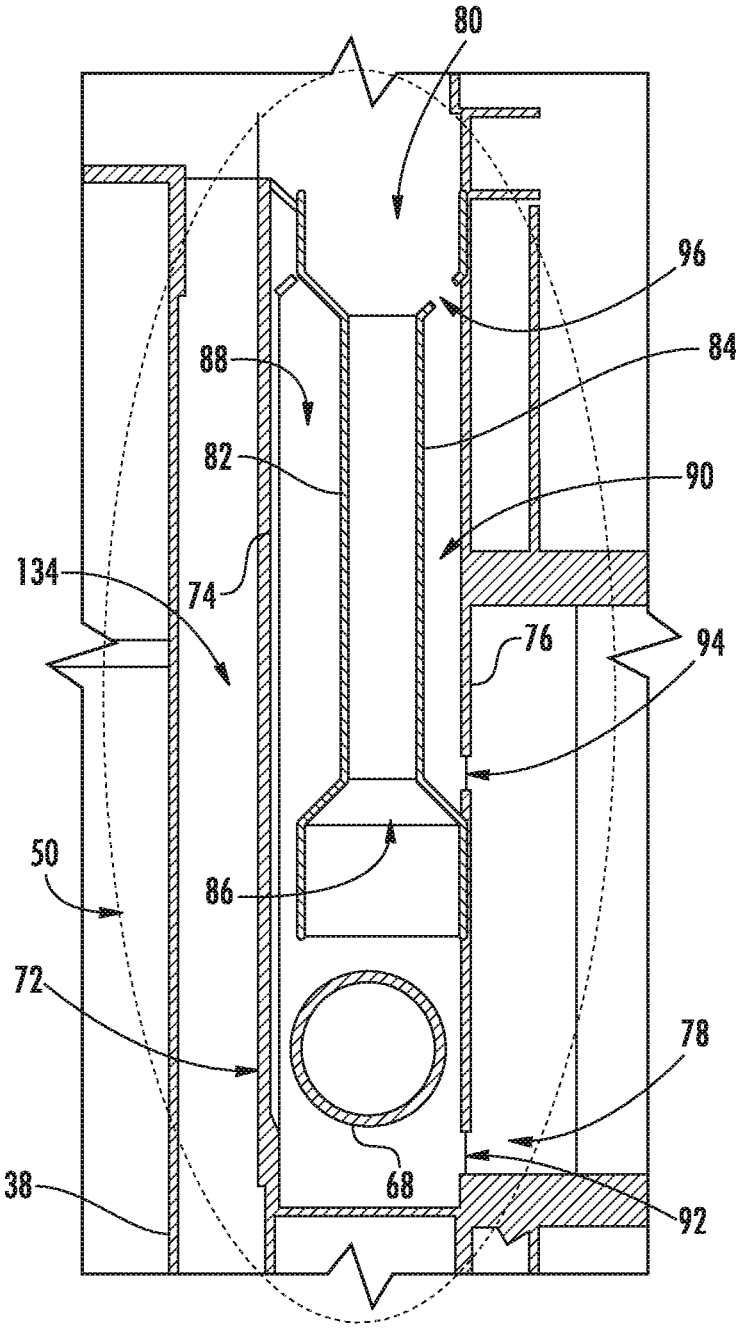
FIG. 3 provides a magnified sectional view of a heating element of the example oven appliance of FIG. 2.

Turning now to the figures, FIGS. 1 through 3 provide several views of example embodiments of the present subject matter. For instance, FIG. 1 provides a perspective view of an oven appliance 10 according to example embodiments of the present subject matter. FIG. 2 provides a section view of oven appliance 10 taken along the 2-2 line of FIG. 1. FIG. 3 provides a magnified sectional view of a heating element of the example oven appliance of FIG. 2. Oven appliance 10 defines a vertical direction V, a lateral direction L, and a transverse direction T. The vertical direction V, lateral direction L, and transverse direction T are mutually perpendicular and form an orthogonal direction system. As will be understood, oven appliance 10 is provided by way of example only, and the present subject matter may be used in any suitable oven appliance. Thus, the present subject matter may be used with other oven or range appliance configurations, e.g., that define multiple interior cavities for the receipt of food and/or having different configuration than what is shown in FIG. 2.

Oven appliance 10 includes an insulated cabinet 12 with an interior cooking chamber 14 defined by an interior surface 15 of cabinet 12. Cooking chamber 14 is configured for the receipt of one or more food items to be cooked. Oven appliance 10 includes a door 16 rotatably mounted to cabinet 12, e.g., with a hinge (not shown). A handle 18 is mounted to door 16 and assists a user with opening and closing door 16 in order to access opening 20 to cooking chamber 14. For example, a user can pull on handle 18 to open or close door 16 and access cooking chamber 14 through opening 20.

Oven appliance 10 can includes a seal (not shown) between door 16 and cabinet 12 that assist with maintaining heat and cooking fumes within cooking chamber 14 when door 16 is closed as shown in FIG. 2. Multiple parallel glass panes 22 provide for viewing the contents of cooking chamber 14 when door 16 is closed and assist with insulating cooking chamber 14. A baking rack 24 is positioned in cooking chamber 14 for the receipt of food items or utensils containing food items. Baking rack 24 is slidably received onto embossed ribs 26 or sliding rails such that rack 24 may be conveniently moved into and out of cooking chamber 14 when door 16 is open.

As shown, various sidewalls define the cooking chamber 14. For example, cooking chamber 14 includes a top wall 30 and a bottom wall 32 which are spaced apart along the vertical direction V. Left sidewall 34 and right sidewall 36 (as defined according to a front view as shown in FIG. 1) extend between the top wall 30 and bottom wall 32, and are spaced apart along the lateral direction L. A rear wall 38 additionally extends between the top wall 30 and bottom wall 32 as well as between the left sidewall 34 and right sidewall 36, and is spaced apart from the door 16 along the transverse direction T. Cooking chamber 14 is thus defined between the top wall 30, bottom wall 32, left sidewall 34, right sidewall 36, and rear wall 38.

Optionally, a lower heating assembly 42 may be included in oven appliance 10, e.g., for baking operations within cooking chamber 42. Lower heating assembly 42 may include a discrete heating element (not pictured) which is disposed within the cooking chamber 14, such as adjacent to the bottom wall 32. In some embodiments, the lower heating assembly 42 includes a gas burner. Additional components, such as an igniter and a fuel line may be provided in some such embodiments. Alternatively, the lower heating assembly 42 may include an electric heating element, or may be any other suitable burner assembly having any other suitable heating element.

As discussed in detail herein, an upper heating assembly, such as a convection broiler assembly 44, may be included in oven appliance 10. Convection broiler assembly 44 includes one or more air handlers 46, 48, e.g., fans or blowers, and a heating element 50. A broiler plate 52 defining a plurality of apertures 54 may be in fluid communication with air handler(s) 46, 48 and/or heating element 50. As illustrated, broiler plate 52 is generally positioned away from heating element 50 such that convection heat (and not radiation heat) is received from heating element 50. Heating element 50 may be an electric heating element, such as a resistive heating rod (not pictured), or a gas burner configured to generate a heated gas for cooking operations. Air handler(s) 46, 48 may be in fluid communication with heating element 50 and the broiler plate 52 to motivate heated gas from the heating element 50 and through the apertures 54 of the broiler plate 52. As will be described in detail below, broiler plate 52 may be provided along a portion of the cooking chamber 14. Moreover, during certain operations, broiler plate 52 may be downstream from air handler(s) 46, 48 and heating element 50 to receive a heated gas therefrom.

Oven appliance 10 may further include a controller 40, e.g., configured to control one or more operations of the oven appliance 10. For example, controller 40 may control at least one operation of oven appliance 10 that includes heating element 50 (and convection broiler assembly 44 generally). Controller 40 may be in communication (via for example a suitable wired or wireless connection) with the heating element 50 and other suitable components of the oven appliance 10, as discussed herein. In general, controller 40 may be operable to configure the oven appliance 10 (and various components thereof) for cooking. Such configuration may be based, for instance, on a plurality of cooking factors of a selected operating cycle or mode.

By way of example, controller 40 may include one or more memory devices and one or more microprocessors, such as general or special purpose microprocessors operable to execute programming instructions or micro-control code associated with an operating cycle. The memory may represent random access memory such as DRAM, or read only memory such as ROM or FLASH. In one embodiment, the processor executes programming instructions stored in memory. The memory may be a separate component from the processor or may be included onboard within the processor.

Controller 40 may be positioned in a variety of locations throughout oven appliance 10. As illustrated, controller 40 may be located within a user interface panel 62 of oven appliance 10 as shown in FIGS. 1 through 3. In some such embodiments, input/output ("I/O") signals may be routed between controller 40 and various operational components of oven appliance 10, such as heating element 50, air handler(s) 46, 48, controls 64, display component 66, sensors, alarms, and/or other components as may be provided. For instance, signals may be directed along one or more wiring harnesses that may be routed through cabinet 12. In some embodiments, controller 40 is in communication with user interface panel 62 and controls 64 through which a user may select various operational features and modes and monitor progress of oven appliance 10. In one embodiment, user interface panel 62 may represent a general purpose I/O ("GPIO") device or functional block. In one embodiment, user interface panel 62 may include input components, such as one or more of a variety of electrical, mechanical or electro-mechanical input devices including rotary dials, push buttons, and touch pads. User interface panel 62 may include a display component 66, such as a digital or analog display configured to provide operational feedback to a user.

As noted above, certain embodiments of heating element 50 are provided as a gas burner. In some such embodiments, heating element 50 includes a burner tube 68. Burner tube 68 is generally positioned away from broiler plate 52 such that a flame output by burner tube 68 is isolated and apart from broiler plate 52, e.g., thereby preventing the flame from contacting broiler plate 52. A fuel line 70 (FIG. 4) may be connected in fluid communication with burner tube 68 to selectively direct a fuel (e.g., natural gas) to burner tube 68. One or more igniters (not pictured) may be provided adjacent to burner tube 68 for igniting fuel. During operation, a flame can thus be generated at burner tube 68 after fuel is received at burner tube 68.

In some embodiments, a burner enclosure 72 contains at least a portion of heating element 50. For instance, burner enclosure 72 may include a plurality of outer walls 74, 76 housing burner tube 68. Outer walls 74, 76 may be substantially solid, non-permeable members to partially isolate burner tube 68. During use, a flame generated at the burner tube 68 is at least partially contained by burner enclosure 72, e.g., apart from broiler plate 52. Specifically, the flame is at least partially enclosed by outer walls 74, 76. An inlet 78 is defined through one or more of outer walls (e.g., 76), while one or both of the outer walls 74, 76 define a separate outlet 80. For instance, outer walls 74, 76 may collectively define an outlet 80 directly above burner tube 68. Inlet 78 may generally permit air into burner enclosure 72 while outlet 80 directs a flame exhaust out of burner enclosure 72, e.g., as a heated gas.

Burner enclosure 72 may include a plurality of inner walls 82, 84, such as a first inner wall 82 and an oppositely-disposed second inner wall 84. Inner walls 82, 84 may be spaced apart, e.g., in the transverse direction T. Moreover, inner walls 82, 84 may be bounded by outer walls 74, 76 within burner enclosure 72. Optionally, inner walls 82, 84 may form a flame hood disposed over burner tube 68. During use, a flame generated at burner tube 68 may extend into, and be contained within, flame hood formed by inner walls 82, 84. In turn, inner walls 82, 84 may at least partially isolate the flame from the outer walls 74, 76, e.g., such that the flame does not contact inner walls 82, 84.

An exhaust path 86 may be defined between the oppositely-disposed inner walls 82, 84. For instance, exhaust path 86 may extend between burner tube 68 and outlet 80 of burner enclosure 72. In some such embodiments, inner walls 82, 84 are spaced apart from outer walls 74, 76, e.g., in the transverse direction T. One or more air chambers 88, 90 may be defined between an inner wall 82, 84 and an outer wall 74, 76 of burner enclosure 72. One air chamber 88 may extend in the transverse direction T toward the cooking chamber 14 between first inner wall 82 and an outer wall 74 of burner enclosure 72. Another air chamber 90 may extend in the transverse direction T away from the cooking chamber 14 between second inner wall 84 and another outer wall 76 of burner enclosure 72.

In some embodiments, inlet 78 includes a plurality of openings 92, 94 extending through an outer wall 76 of burner enclosure 72, e.g., in the transverse direction T. Optionally, multiple discrete sets of openings may be provided. For instance, a primary set of openings 92 may extend through outer wall 76 of burner enclosure 72. As illustrated, primary openings 92 may extend through outer wall 76 below inner walls 82, 84, e.g., in the vertical direction V. In some such embodiments, primary openings 92 are defined below burner tube 68. Each of the primary openings 92 may be substantially parallel. Additionally or alternatively, each of the primary openings 92 may be defined along a sequence such that the primary openings 92 are arranged side-by-side in the lateral direction L (See FIG. 4).

A secondary set of openings 94 may further extend through outer wall 76 of burner enclosure 72. As illustrated, secondary openings 94 may extend through outer wall 76 above burner tube 68, e.g., in the vertical direction V. In some such embodiments, secondary openings 94 extend into an air chamber 88, 90. Each of the secondary openings 94 may be substantially parallel. Additionally or alternatively, each of the secondary openings 94 may be defined along a sequence such that the primary openings 92 are arranged side-by-side in the lateral direction L (See FIG. 4).

Optionally, one or more ports 96 may be defined in fluid communication with inlet 78. As illustrated, ports 96 may be extend from an air chamber 88, 90 to outlet 80. Moreover, ports 96 may be defined above secondary openings 94, e.g., proximate to outlet 80. For instance, ports 96 may be defined through an angled top portion of inner wall 82, 84. During operations, air may be directed through air chamber 88, 90 (e.g., from secondary openings 94) and out of ports 96.

An isolated air supply duct 110 is provided in some embodiments. As shown, air supply duct 110 defines a passage 112 that extends between two ends 114, 116. When assembled, passage 112 may be in fluid communication with burner enclosure 72. An inlet 118 of air supply duct 110 may be defined at one end 114 while an outlet 120 is defined at the opposite end 116. Optionally, air supply duct 110 may be partially or fully housed within cabinet 12. In some such embodiments, inlet 118 is defined in communication with the ambient environment, e.g., at a bottom portion of cabinet 12. Outlet 120 of air supply duct 110 may be defined adjacent to the inlet 78 of burner enclosure 72, e.g., in direct engagement with burner enclosure 72. Air for combustion may thus enter air supply duct 110 at inlet 118 before passing through passage 112 to outlet 120. Air passing from outlet 120 may then enter burner enclosure 72 at inlet 78, e.g., through primary opening(s) 92 and/or secondary opening(s) 94.

In some embodiments one or more combustion air handlers 48, such as a burner fan, is disposed upstream from heating element 50, e.g., upstream from a gas burner. Specifically, combustion air handler 48 may be in fluid communication with inlet 78 of burner enclosure 72. Isolated air supply duct 110 disposed in fluid communication between the air handler 48 and inlet 78 of heating element 50. Optionally, combustion air handler 48 may be disposed within passage 112 of air supply duct 110. During operations, combustion air handler 48 may motivate air into inlet 78, e.g., to facilitate combustion within burner enclosure 72 and/or force heat exhaust from burner enclosure 72.

In certain embodiments, a convection duct 130 is provided in fluid communication with cooking chamber 14. Convection duct 130 may extend along a portion of the cooking chamber 14, e.g., outside of cooking chamber 14, to direct a heated gas therethrough. For instance, convection duct 130 may extend from heating element 50 to broiler plate 52. A passage, e.g., a broiler passage 132 defined by convection duct 130 may provide fluid communication between heating element 50 and broiler plate 52. In some such embodiments, broiler passage 132 extends along top wall 30 of cooking chamber 14 from the outlet 80 of burner enclosure 72. Broiler passage 132 may be defined, e.g., perpendicular to the vertical direction V. In additional or alternative embodiments, a passage, e.g., a circulation passage 134, is defined by convection duct 130. Specifically, circulation passage 134 may be defined in fluid communication between a bottom portion of cooking chamber 14 and a top portion of cooking chamber 14, e.g., through broiler passage 132. In certain embodiments, circulation passage 134 extends along the vertical direction V, e.g., perpendicular to the transverse direction T. At least a portion of circulation passage 134 may be defined by rear wall 38, e.g., between rear wall 38 and an outer wall 74 of burner enclosure 72.

One or more convection air handlers 46, such as a circulation fan, are disposed in fluid communication with convection duct 130. Through convection duct 130, convection air handler 46 may be in fluid communication with outlet 80 of burner enclosure 72. Convection air handler 46 may be operable to direct a heated gas through convection duct 130 according to one or more operations. During certain operations, air may be recirculated from one portion of cooking chamber 14 to another portion. For instance, convection air handler 46 may motivate air through broiler passage 132 and to or from broiler plate 52, as will be described below. In some embodiments, convection air handler 46 is disposed within convection duct 130, e.g., mounted at the circulation passage 134. Moreover, convection air handler 46 may be positioned below heating element 50 along the vertical direction V.

Figure 4:
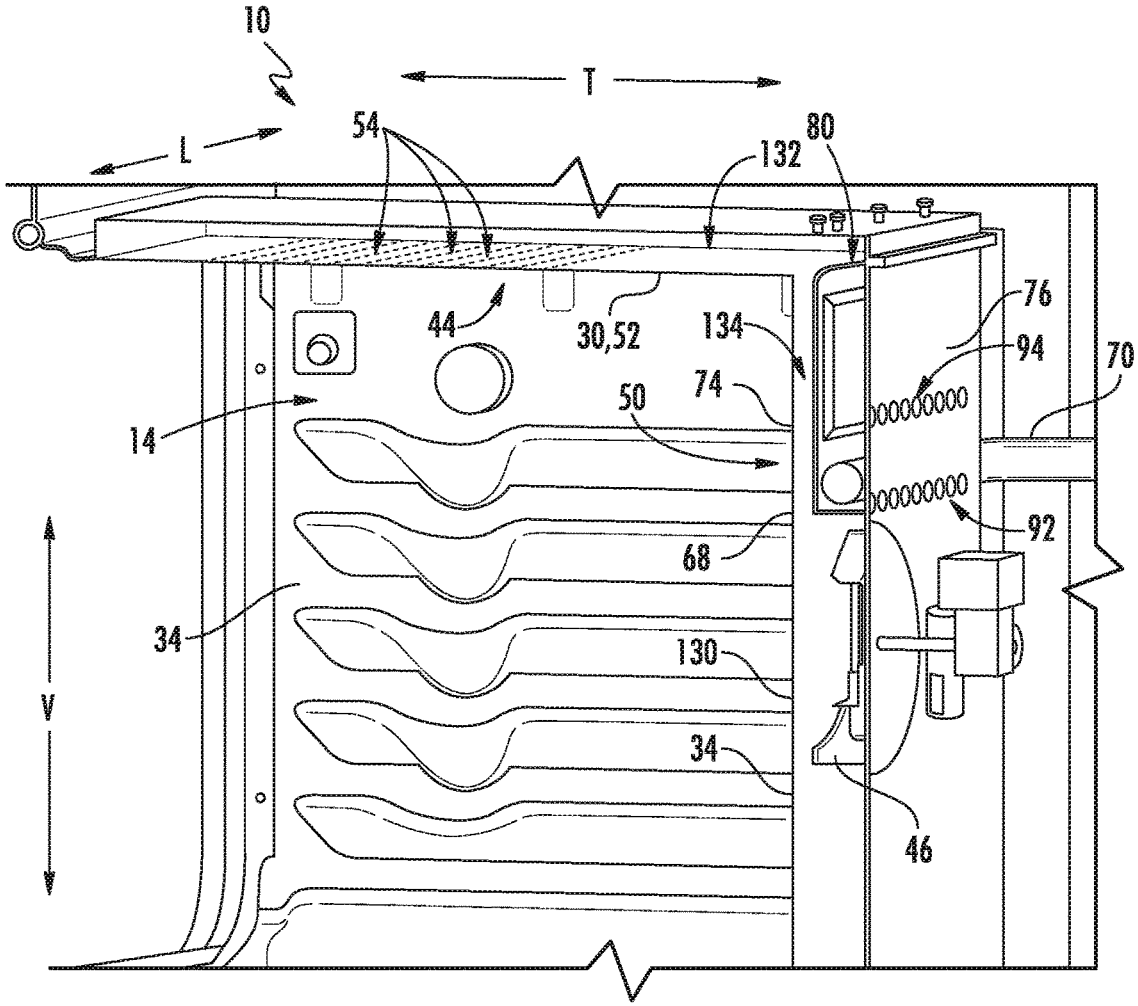
FIG. 4 provides a sectional perspective view of a rear portion of an oven appliance according to example embodiments of present disclosure.

Turning now to FIG. 4, broiler plate 52 is positioned at a top portion of the cooking chamber 14 in fluid communication with convection duct 130. Broiler plate 52 may be a substantially planar member extending, e.g., perpendicular to the vertical direction V, along a portion cooking chamber 14. In some embodiments, broiler plate 52 defines at least a portion of top wall 30. Advantageously, broiler plate 52 may thus avoid encroaching into cooking chamber 14 and reducing the volume thereof. In example embodiments, broiler plate 52 extends from one opposing sidewall 34 to the other opposing sidewall 36 (FIG. 1) along the lateral direction L, as illustrated in FIG. 4. In additional or alternative embodiments, broiler plate 52 extends from the rear wall 38 to the opening of cooking chamber 14. Optionally, the broiler plate 52 may form the entire top wall 30.

One or more apertures 54 are defined through broiler plate 52, e.g., as slots or holes, to direct a heated gas to the cooking chamber 14. Apertures 54 may be in fluid communication between convection duct 130 and cooking chamber 14. For instance, the apertures 54 may extend, e.g., in the vertical direction V, through broiler plate 52 from the broiler passage 132 to cooking chamber 14.

Figure 5:
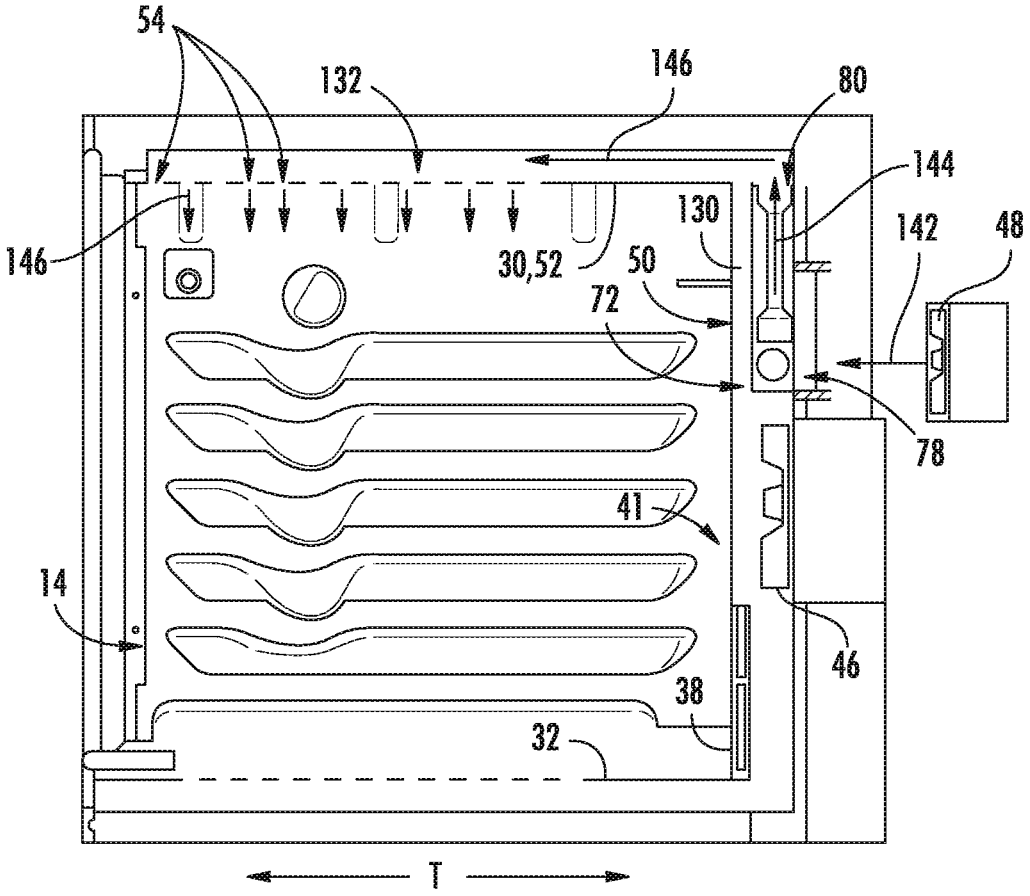
FIG. 5 provides a sectional view of portion of an oven appliance according to example embodiments of present disclosure.

As illustrated in FIG. 5, appliance is operable to motivate a heated gas into cooking chamber 14, e.g., in order to heat or cook food items positioned below broiler plate 52. One or more modes, such as a broiler mode, may be provided. Controller 40 (FIG. 1) may initiate the broiler mode in response to one or more user inputs, e.g., provided through controls 64 (FIG. 1).

An initial airflow (indicated at arrow 142) may be provided to heating element 50. For instance, an initial air volume may be motivated through inlet 78 into burner enclosure 72 by air handler 48. The initial airflow 142 may be provided from the ambient environment, e.g., through inlet 118 of air supply duct 110 (FIG. 2). Air within burner enclosure 72 may then mix with fuel supplied through burner tube 68.

The mixture of initial airflow 142 and fuel may be ignited to generate a flame exhaust (indicated at arrow 144). Combustion and backpressure generated at combustion air handler 48 may motivate exhaust 144 through outlet 80 into convection duct 130 as a heated gas (indicated at arrows 146) for convection. Optionally, additional air, such as that provided through secondary openings 94 (FIG. 3), may be mixed with exhaust 144, e.g., at outlet 80, to further form heated gas 146. Additionally or alternatively, air from cooking chamber 14 may be recirculated, e.g., by air handler 46, and mixed with exhaust 144 within convection duct 130 to further form heated gas 146.

Heated gas 146 may be guided through broiler passage 132 of convection duct 130 and to broiler plate 52. For instance, exhaust 144 and/or heated gas 146 may be directed exclusively to broiler plate 52, e.g., as a solely convective heat source for the top portion of cooking chamber 14. At the broiler plate 52, heated gas 146 may be guided through the apertures 54 and into cooking chamber 14. Advantageously, the heated gas 146 may directly heat any items, e.g., food items, positioned beneath broiler plate 52. Moreover, heat may be received immediately from the heated gas 146. The size and spacing of the apertures 54 may control the distribution of heated gas 146, providing the desired heat to cooking chamber 14 and/or items therein.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. Oven appliance comprising:

a cabinet defining a cooking chamber to receive items to be cooked, the cabinet comprising a top wall, a bottom wall, a rear wall, and opposing sidewalk, the top wall and the bottom wall being spaced apart along a vertical direction, the opposing sidewalk being spaced apart along a lateral direction; and a convection broiler assembly comprising a broiler passage defined along a top portion of the cooking chamber to direct a heated gas thereto, a heating element disposed in convective communication with the broiler passage to supply the heated gas therein, and an air handler in fluid communication with the heating element and the broiler passage to motivate the heated gas through the broiler passage, wherein the heating element is a gas burner upstream of the broiler passage and the cooking chamber, the gas burner comprising a burner tube to receive a combustion fuel, and a burner enclosure spaced apart from the cooking chamber, the burner enclosure housing the burner tube outside of the cooking chamber to contain a flame and direct an exhaust of the flame to the broiler passage as a portion of the heated gas.

2. The oven appliance of claim 1, wherein the air handler is disposed upstream from the gas burner, and wherein the burner enclosure defines an inlet to receive an airflow from the air handler.

3. The oven appliance of claim 2, further comprising an isolated air supply duct disposed in fluid communication between the air handler and the inlet of the gas burner.

4. The oven appliance of claim 1, wherein the air handler is disposed within the cabinet and positioned below the heating element along the vertical direction.

5. The oven appliance of claim 1, further comprising a broiler plate defining at least one aperture in fluid communication between the broiler passage and the cooking chamber, wherein the broiler plate defines at least a portion of the top wall.

6. The oven appliance of claim 5, further comprising a convection duct extending from the heating element to the broiler plate.

7. The oven appliance of claim 1, further comprising a controller operably connected to the air handler and configured to initiate a broiling operation, the broiling operation including activating the air handler to motivate air through the broiler passage.

8. An oven appliance comprising:

a cabinet defining a cooking chamber to receive items to be cooked, the cabinet comprising a top wall, a bottom wall, a rear wall, and opposing sidewalls, the top wall and the bottom wall being spaced apart along a vertical direction, the opposing sidewalls being spaced apart along a lateral direction;

a convection duct extending along a portion of the cooking chamber to direct a heated gas therethrough;

a heating element disposed within the convection duct to supply the heated gas thereto;

an air handler disposed in fluid communication with the convection duct to motivate the heated gas; and a broiler passage defined at a top portion of the cooking chamber in fluid communication with the convection duct to direct the heated gas from the convection duct to the cooking chamber, wherein the heating element is a gas burner upstream of the broiler passage and the cooking chamber, the gas burner comprising a burner tube to receive a combustion fuel, and a burner enclosure spaced apart from the cooking chamber, the burner enclosure housing the burner tube outside of the cooking chamber to contain a flame and direct an exhaust of the flame to the broiler passage as a portion of the heated gas.

9. The oven appliance of claim 8, wherein the air handler is disposed upstream from the gas burner, and wherein the burner enclosure defines an inlet to receive an airflow from the air handler.

10. The oven appliance of claim 9, further comprising an isolated air supply duct disposed in fluid communication between the air handler and the inlet of the gas burner.

11. The oven appliance of claim 8, wherein the air handler is disposed within the cabinet and positioned below the heating element along the vertical direction.

12. The oven appliance of claim 8, further comprising a broiler plate defining at least one aperture in fluid communication between the broiler passage and the cooking chamber.

13. The oven appliance of claim 12, wherein the broiler plate extends from one opposing sidewall to the other opposing sidewall along the lateral direction.

14. The oven appliance of claim 8, wherein a portion of the convection duct is defined by the rear wall.

15. The oven appliance of claim 8, further comprising a controller operably connected to the air handler and configured to initiate a broiling operation, the broiling operation including activating the air handler to motivate air through the broiler passage.

* * * * *